US005590637A

United States Patent [19]

Motodate

[11] Patent Number: 5,590,637

[45] Date of Patent: Jan. 7, 1997

[54] IGNITION COIL DEVICE

[75] Inventor: Shoji Motodate, Saitama, Japan

[73] Assignee: Honda Giken Kogyo Kabushiki Kaisha, Tokyo, Japan

[21] Appl. No.: 488,432

[22] Filed: Jun. 7, 1995

[30] Foreign Application Priority Data

Nov. 4, 1994 [JP] Japan ..... 6-271521

[51] Int. Cl.[6] ..... F02P 3/02

[52] U.S. Cl. ..... 123/634; 180/227; 315/57; 336/107

[58] Field of Search ..... 123/634, 635; 336/107, 96; 315/57; 180/227, 228

[56] References Cited

U.S. PATENT DOCUMENTS 1,011,884 12/1911 Cavanagh ..... 123/634

FOREIGN PATENT DOCUMENTS 2400246 4/1979 France ..... 336/107

2624559 6/1989 France ..... 123/635

62-179364 11/1987 Japan .

*Primary Examiner*—Andrew M. Dolinar

[57] ABSTRACT

An ignition coil device has a plug cap engaging a spark plug; a secondary coil surrounding the plug cap; a primary coil coaxially surrounding the secondary coil; a cylindrical case with a bottom surrounding the plug cap, the secondary coil and the primary coil; and a sealing member for sealing an opening of the case. Furthermore, the coil ends of the primary coil extend close to a bottom of the case and are individually connected to terminals which extend substantially perpendicular to a longitudinal axis of the spark plug. The coil ends and the external wiring are not passed through the sealing member, thereby improving the sealability of the ignition coil. Further, because the coil ends and the external wiring do not interfere with the sealing member, they are not worn by vibrations, thereby improving the durability of the external wiring.

16 Claims, 7 Drawing Sheets

IGNITION COIL DEVICE

BACKGROUND OF THE INVENTION

1. Field of the Invention

The present invention relates to an improvement in an ignition coil device adapted to be directly mounted to a spark plug of an engine.

2. Description of the Background Art

A conventional ignition coil device is disclosed, for example, in Japanese Utility Model Laid-open No. Sho 62-179364 (entitled Ignition Coil). The conventional technique has a spark plug connection cap that engages with a spark plug; a secondary coil surrounding the spark plug connection cap; a primary coil coaxially surrounding the secondary coil; a cylindrical case having a bottom and surrounding the spark plug connection cap, the secondary coil, and the primary coil; and sealing rubber for sealing an opening of the case. A lead cable leading from the coil passes near the opening of the case and extends through the sealing rubber to the outside.

In the above background art, however, the sealability of the sealing rubber cannot be easily ensured because the lead cable leading from the coil extends through the sealing member to the outside.

Further, the conventional lead cable interferes with the sealing rubber and rubs against the sealing rubber due to vibrations from the engine.

SUMMARY AND OBJECTS OF THE INVENTION

It is accordingly an object of the present invention to improve the sealability of the sealing member and the durability of the external wiring leading from the coil.

According to the present invention, there is provided in an ignition coil device including a plug cap adapted to be engaged with a spark plug; a secondary coil surrounding the plug cap; a core mounted between the plug cap and the secondary coil, the core having a tubular shape and being integrally mounted on the plug cap; a secondary coil bobbin coaxially surrounding and separate from the plug cap, the secondary coil being wound on the secondary coil bobbin; a primary coil coaxially surrounding the secondary coil; a cylindrical case having a bottom and surrounding the plug cap, the secondary coil and the primary coil; and a sealing member for sealing an opening of the case. The coil ends of the primary coil extend close to a bottom of the cylindrical case wherein the coil ends are individually connected to terminals that extend substantially perpendicular to a longitudinal axis of the spark plug.

The spark plug is mounted on an engine which is swingably mounted through a link mechanism to a body frame. The terminals are connected through a disconnectable coupler to external wiring.

The coil ends of the primary coil are individually connected to terminals that extend substantially parallel to a plane perpendicular to the longitudinal axis of the spark plug in the vicinity of the bottom of the cylindrical case. The terminals are connected to the external wiring. Accordingly, the coil ends of the primary coil and the external wiring are not passed through the sealing member. Further, as the coil ends and the external wiring do not interfere with the sealing member, they do not rub against the sealing member due to vibrations.

Because the coil ends of the primary coil extend close to the bottom of the case, the end position of the primary coil windings can be made specific.

Because the primary coil ends are individually connected to terminals extending substantially perpendicular to the longitudinal axis of the spark plug, the arrangement about the bottom of the case can be made compact.

Because the spark plug is mounted on the engine which is swingably mounted through the link mechanism to the body frame, the swing range of the spark plug can be made narrow. Accordingly, the swing range of the ignition coil device can also be made narrow.

Because the terminals are connected through a disconnectable coupler to the external wiring, a wiring operation can be easily carried out.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
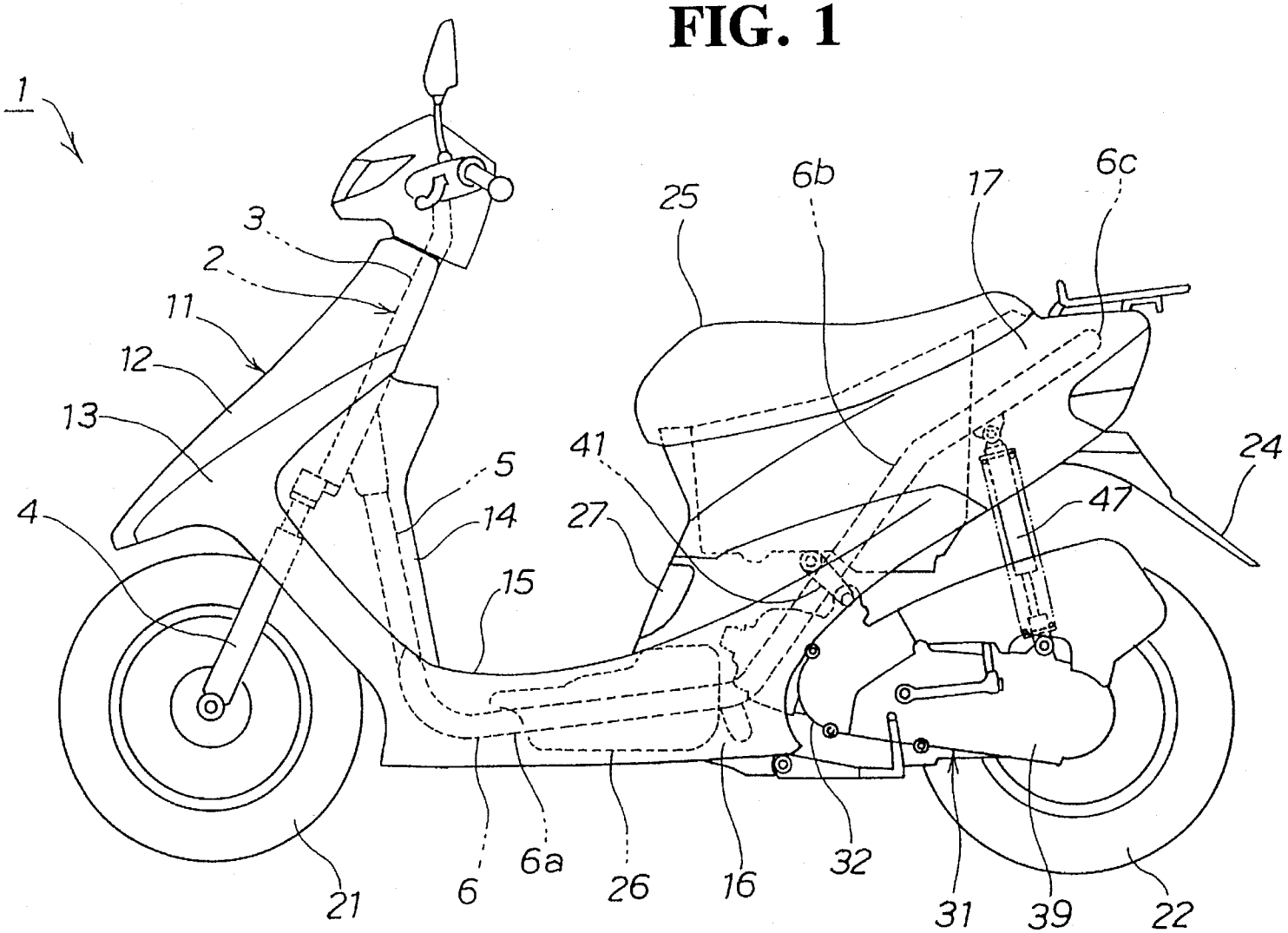
FIG. 1 is a side view of a scooter-type motorcycle according to the present invention.

A preferred embodiment of the present invention will now be described with reference to the accompanying drawings. The terms of "front", "rear", "left", and "right" used hereinafter are based on the direction as viewed from a rider, and the orientation of each drawing is the same as that of reference numerals included therein.

FIG. 1 is a side view of a scooter type motorcycle 1 according to the present invention. The scooter type motorcycle 1 includes a body frame 2, a body cover 11 covering the body frame 2, a front wheel 21, a rear wheel 22, a seat 25, a fuel tank 26, a power unit 31, and a rear cushion 47.

The body frame 2 is composed of a head pipe 3, a front fork 4 steerably supported by the head pipe 3, a down tube 5 extending downward from the head pipe 3, and a rear frame 6 extending rearward from the lower end of the down tube 5. The front wheel 21 is suspendedly supported to the lower end portion of the front fork 4.

The rear frame 6 is composed of a pair of right and left front frame portions 6*a* (only the left front frame is shown in FIG. 1) extending substantially horizontally in a rearward direction from the lower end of the down tube 5. The rear frame 6 also includes a pair of right and left intermediate frame portions 6*b* extending rearward and upward from the rear ends of the front frame portions 6*a*, and a rear frame portion 6*c* connecting the rear ends of the intermediate frame portions 6*b*. Thus, the rear frame 6 has a substantially elliptical shape.

The body cover 11 includes a front cover 12 and a front side cover 13 for covering the front portion of the head pipe 3 and the upper portion of the front wheel 21. Body cover 11 also includes a leg shield 14 for covering the front side of a rider's legs, a floor board 15 for supporting a rider's feet, a rear lower cover 16 for covering the right and left sides of the rear portion of the body frame 2, and a rear upper cover 17 for covering the upper side of the rear portion of the body frame 2. A rear fender 24 for covering the upper portion of the rear wheel 22 is mounted on the rear portion of the rear upper cover 17.

The rear upper cover 17 has an upper opening that is covered by the seat 25. The seat 25 is hinged to the rear upper cover 17 so as to allow the upper opening to be opened or closed.

The fuel tank 26 is mounted on the front frame portion 6*a*.

The power unit 31 is composed of a 2-cycle forced air-cooled engine 32 and a continuously variable transmission 39 for transmitting the power of the engine 32 to the rear wheel 22. The engine 32 is located at the front portion of the power unit 31 and the continuously variable transmission 39 is located at the front portion of the power unit 31. The rear wheel 22 is mounted on the continuously variable transmission 39.

The rear suspension of the motorcycle 1 is of a swing arm type such that the power unit 31 is used as a swing arm and is suspended from the rear portion of the body frame 2 through the rear cushion (damper) 47.

More specifically, the front portion (engine 32) of the power unit 31 is mounted through a link mechanism 41 to the intermediate frame portion 6*b* so as to be swingable in the longitudinal direction of the motorcycle 1 (in the direction of forward travel of the motorcycle 1). The rear cushion 47 is interposed between the intermediate frame portion 6*b* and the rear portion of the power unit 31.

Figure 2:
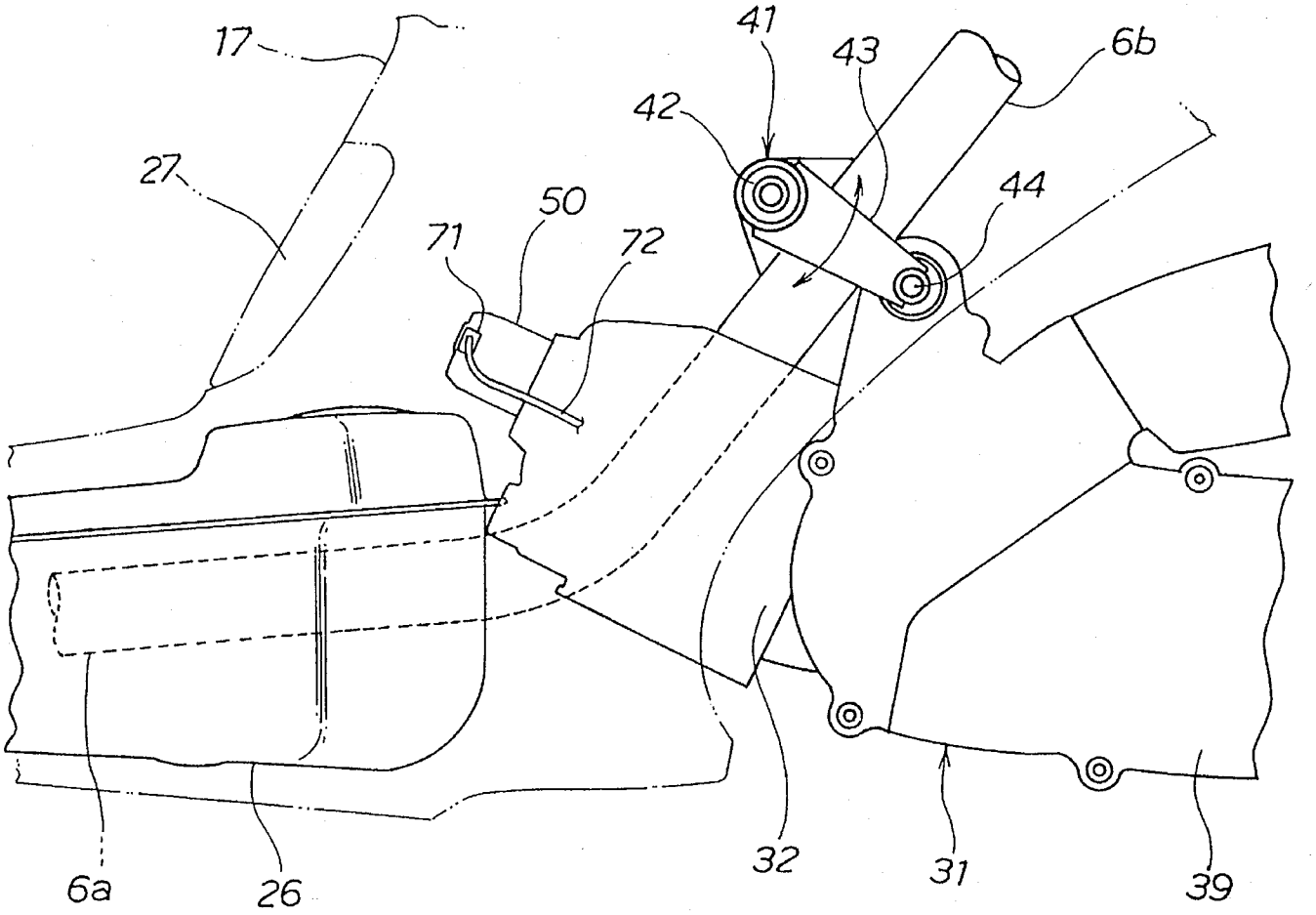
FIG. 2 is a side view of an engine and a fuel tank according to the present invention.

FIG. 2 is a side view of the engine 32 and the fuel tank 26 according to the present invention, showing the structural relationship between the fuel tank 26 and the engine 32.

The link mechanism 41 is composed of a support portion 42 mounted on the intermediate frame portion 6*b*, a link 43 pivotally supported by support portion 42, and a pivot 44 connected to the swing end of the link 43 so as to be swingable in the longitudinal direction of the motorcycle 1 (in the direction of forward travel of the motorcycle 1). The pivot 44 is integrally formed with the upper portion of a cylinder block (not shown) of the engine 32.

An ignition coil device 50 is mounted on the front end of the engine 32. The ignition coil device 50 is located in the vicinity of the fuel tank 26.

A lid 27 is provided at the front portion of the rear upper cover 17 to allow fuel supply into the fuel tank 26.

Figure 3:
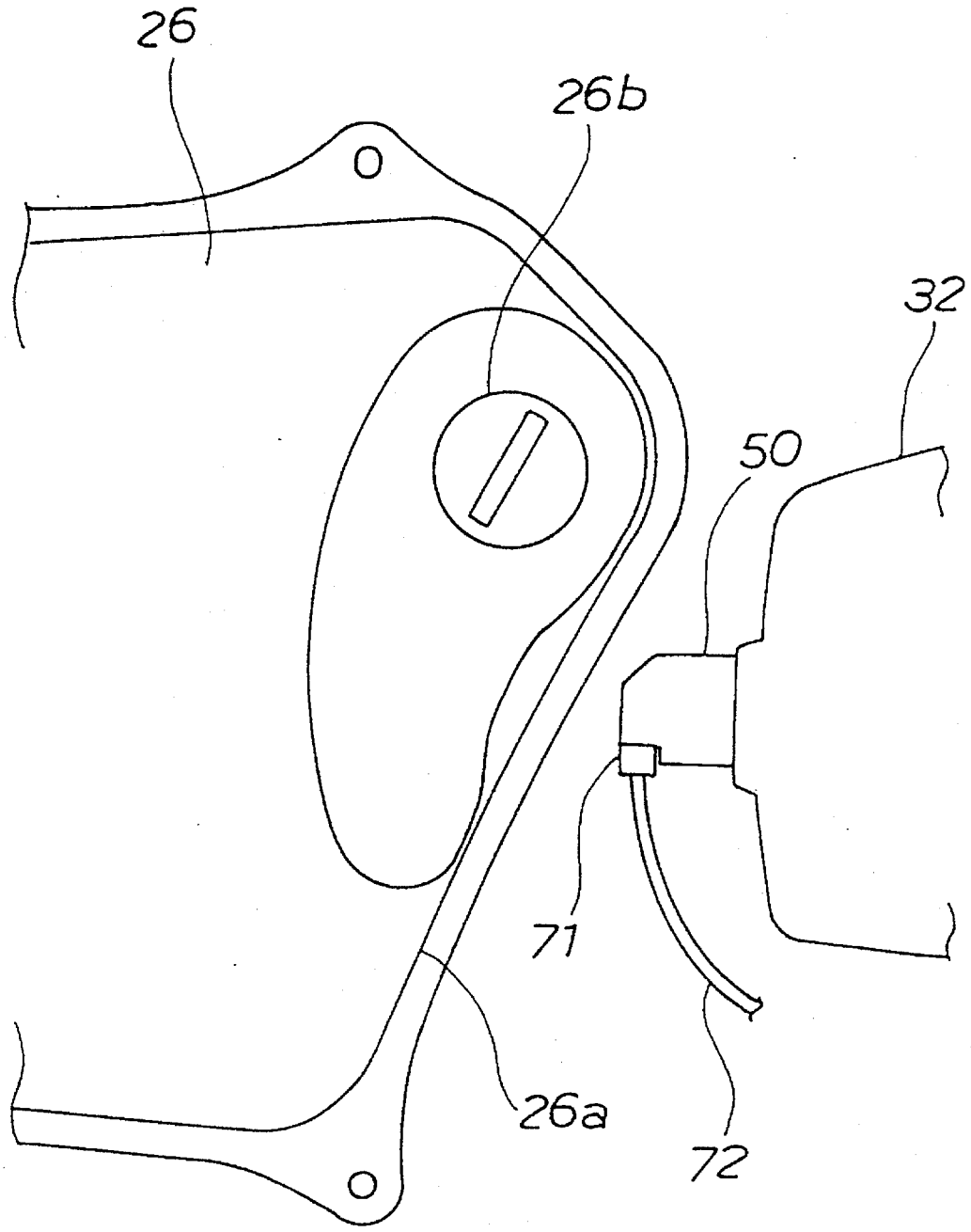
FIG. 3 is a plan view of the engine and the fuel tank according to the present invention.

FIG. 3 is a plan view of the engine 32 and the fuel tank 26 according to the present invention, showing that a rear end surface 26*a* of the fuel tank 26 is obliquely retracted to avoid the interference with the ignition coil device 50 which is located close to the fuel tank 26.

A fuel filler opening 26*b* is provided to allow fueling of the fuel tank 26.

A coupler 71 is plugged in the left side (lower side as viewed in FIG. 3) of the ignition coil device 50. Accordingly, the coupler 71 and the external wiring 72 are prevented from coming into contact with the rear end surface 26*a* of the fuel tank 26.

Figure 4:
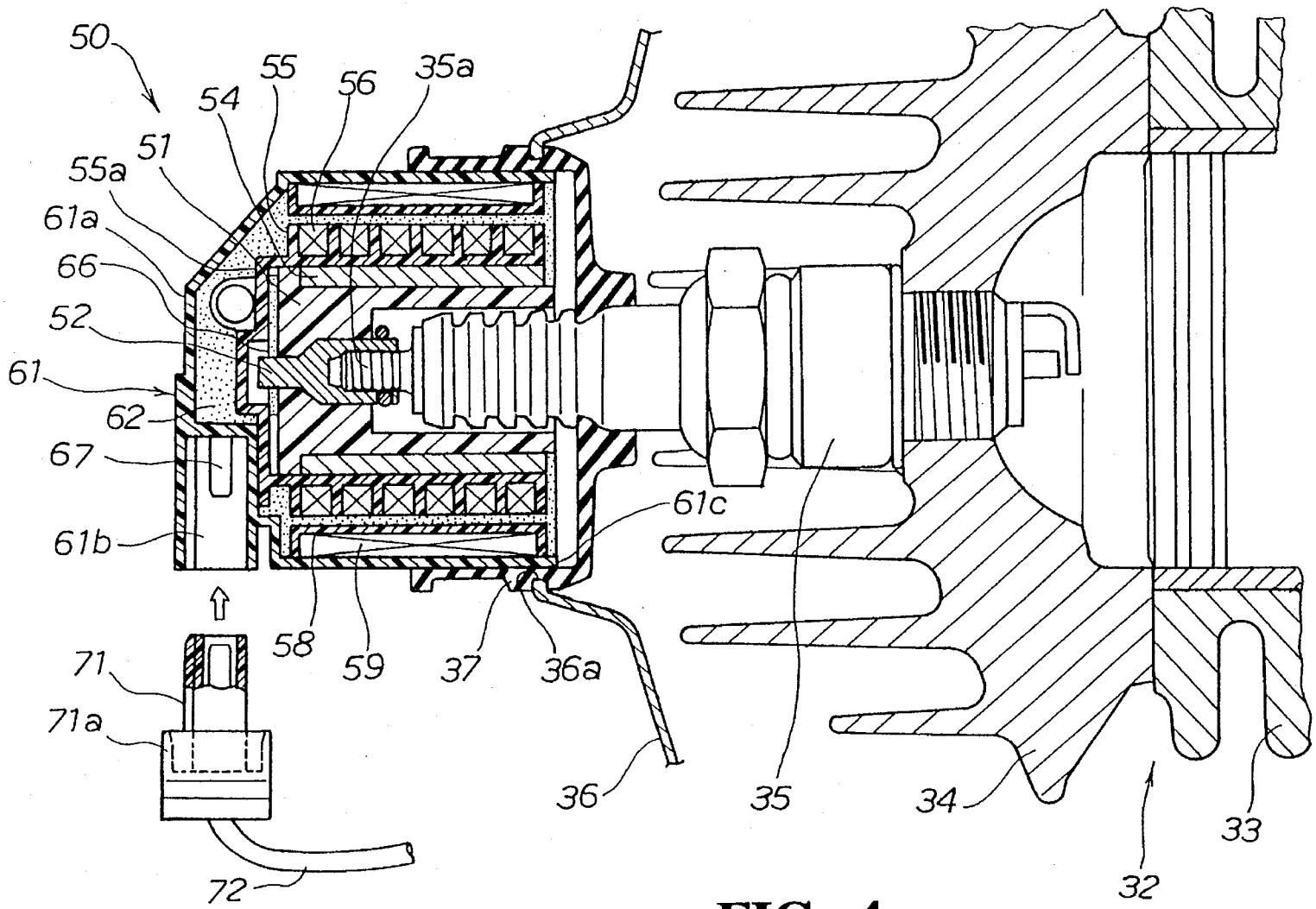
FIG. 4 is a horizontal sectional view of an ignition coil device according to the present invention.

FIG. 4 is a horizontal sectional view of the ignition coil device 50 according to the present invention, in which there is shown a spark plug 35 screwed into a cylinder head 34 of the engine 32.

A cylinder block 33 and the cylinder head 34 of the engine 32 are covered with an engine cover (shroud) 36. The engine cover 36 is formed with an opening 36*a* that allows insertion of the spark plug 35 into cylinder head 34. A flexible cylindrical sealing member 37 with a bottom portion is engaged with the opening 36*a*.

The ignition coil device 50 includes a cylindrical plug cap 51 having a bottom portion that is engaged with the spark plug 35, a cylindrical core 54 fixed to the outer cylindrical portion of the plug cap 51 (the core 54 being formed from a permanent magnet), a cylindrical secondary coil bobbin 55 engaged with the outer peripheries of the plug cap 51 and the core 54, a secondary coil 56 wound around the secondary coil bobbin 55, a cylindrical primary coil bobbin 58 surrounding the secondary coil bobbin 55 and the secondary coil 56, a primary coil 59 wound around the primary coil bobbin 58, and a cylindrical case 61 having a bottom and surrounding members 51, 54, 55, 56, 58, and 59. Members 51, 54, 55, 56, 58, and 59 and the case 61 are set in a coaxial relationship with respect to the spark plug 35.

The plug cap 51 is formed with an electrical insulator such as an electrically insulating resin. A conductive cap member 52 is fixed to the bottom of the plug cap 51 at the central position thereof. The conductive cap member 52 is detachably engaged at one end thereof with a spark plug terminal 35*a*. The other end of the cap member 52 projects from the bottom of the plug cap 51 and is connected with a cap terminal 66.

The secondary coil bobbin 55 is formed with an electrical insulator such as an electrically insulating resin, and the outer surface of the bottom 55*a* of the secondary coil bobbin 55 serves as a base on which terminals 64 to 67 (to be described in detail with reference to FIG. 5) are arranged.

The case 61 is formed with an electrical insulator such as an electrically insulating resin, and a peripheral portion of the bottom 61*a* of case 61 includes a coupler socket 61*b* extending substantially perpendicular to the longitudinal axis of the spark plug 35. The coupler 71 is removably fitted into the coupler socket 61*b*.

The coupler 71 is integrally formed with a flexible, waterproof boot 71*a* around the coupler 71. When the coupler 71 is plugged in the coupler socket 61*b*, the waterproof boot 71*a* tightly contacts the outer circumferential surface of the coupler socket 61*b* to provide a waterproof seal.

An opening end 61*c* of case 61 is inserted through the opening 36*a* of engine cover 36 with the sealing member 37 interposed therebetween. The sealing member 37 not only seals the opening of the case 61, but also serves as a vibration damper for suppressing the transmission of vibrations from the engine 32 to the case 61.

The case 61 is filled with a filler 62 formed of an electrical insulator such as an electrically insulating resin.

Figure 5:
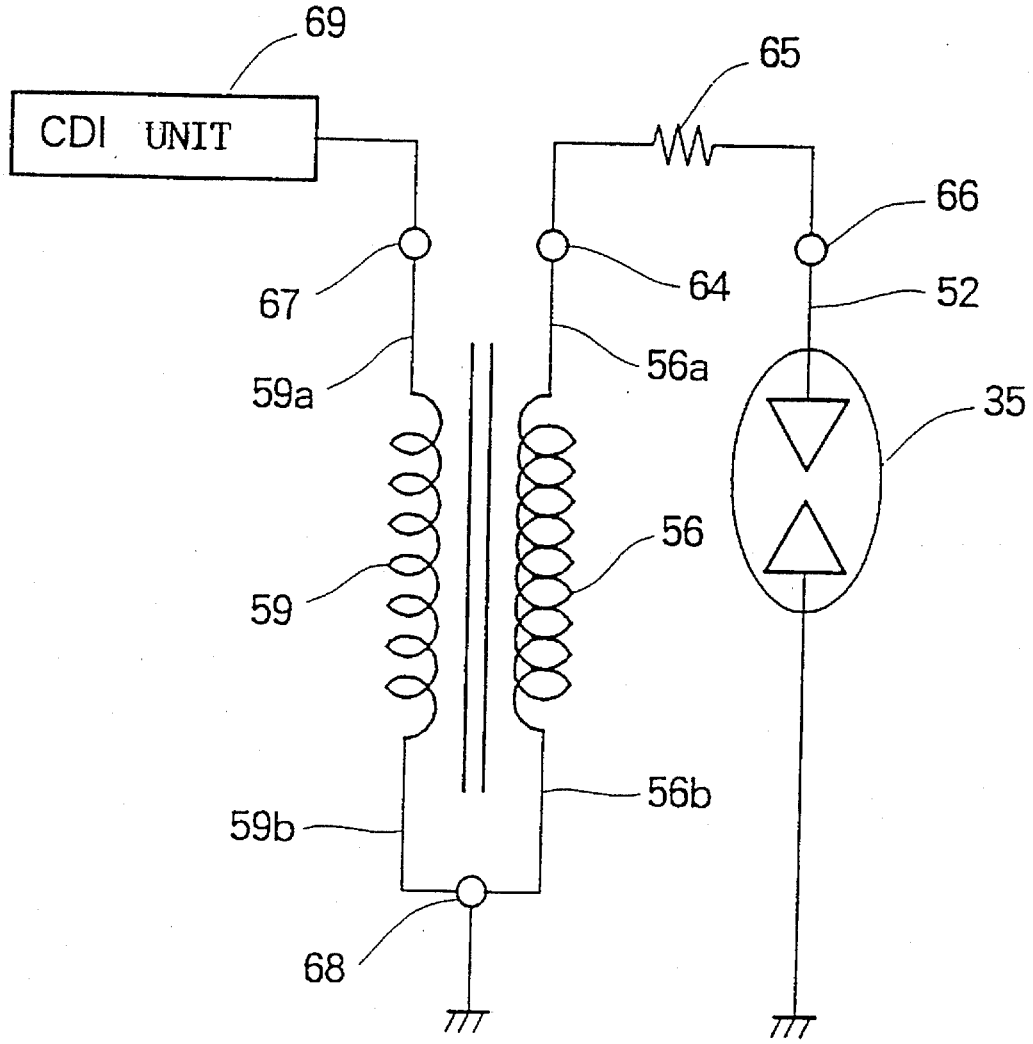
FIG. 5 is a circuit diagram of the ignition coil device according to the present invention.

FIG. 5 is a circuit diagram of the ignition coil device 50 according to the present invention.

A first coil end 56*a* of the secondary coil 56 is connected to a secondary coil positive terminal 64, a radio noise prevention resistor 65, the cap terminal 66, and the cap member 52 to the spark plug 35. A second coil end 56*b* of the secondary coil 56 is connected through a primary/secondary coil negative terminal 68 to ground.

A first coil end 59*a* of the primary coil 59 is connected through a primary coil positive terminal 67 to a CDI unit (capacitive discharge ignition unit) 69. A second coil end 59*b* of the primary coil 59 is connected through the primary/secondary coil negative terminal 68 to ground.

Figure 6:
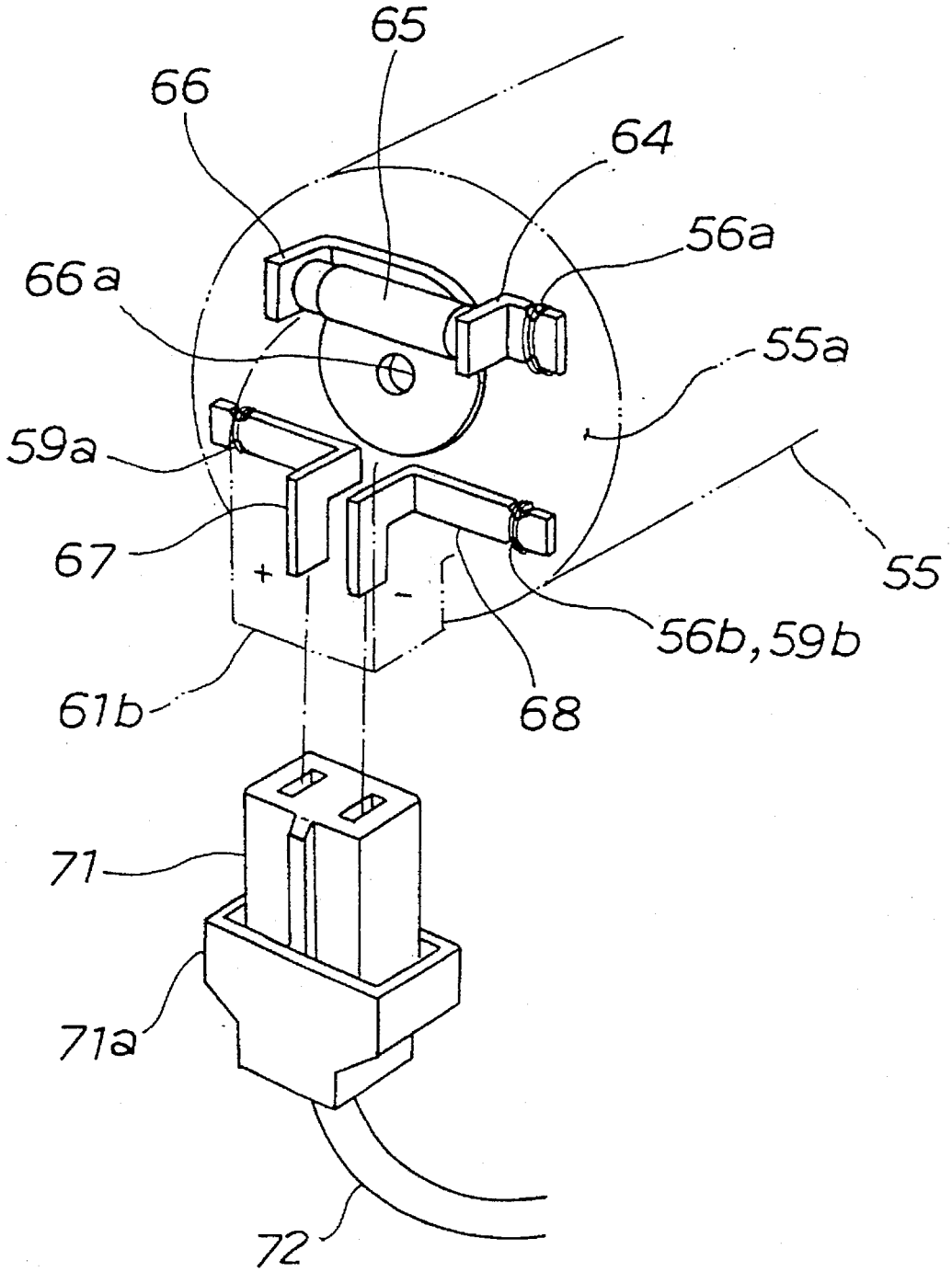
FIG. 6 is an exploded perspective view of terminals of the ignition coil device and a coupler according to the present invention, and FIGS. 7(*a*), 7(*b*) and 7(*c*) are side views illustrating the operation of the engine in relation to the fuel tank according to the present invention.

FIG. 6 is an exploded perspective view of the coupler 71 and the terminals 64 and 66 to 68 of the ignition coil device 50, in which there are shown the terminals 64 and 66 to 68 fixed to the outer surface of the bottom 55*a* of the coil bobbin 55.

The secondary coil positive terminal 64 and the cap terminal 66 both have a substantially L-shaped configuration which oppose each other, and are connected together through the radio noise prevention resistor 65. A central hole 66*a* formed through the lower portion of the cap terminal 66 engages the cap member 52.

The primary coil positive terminal 67 and the primary/secondary coil negative terminal 68 both have a substantially L-shaped configuration opposing each other, and extend substantially perpendicular to the longitudinal axis of the spark plug 35 (see FIG. 4). The opposed end portions of the terminals 67 and 68 are located in the coupler socket 61*b* (coupler socket 61*b* is shown with imaginary lines in FIG. 6), and are connected through the disconnectable coupler 71 to the external wiring 72.

The coil ends 56*a* and 56*b* of the secondary coil 56 extend close to the bottom 61*a* of the case 61 (see FIG. 4) and are individually connected to the secondary coil positive terminal 64 and the primary/secondary coil negative terminal 68, respectively.

Similarly, the coil ends 59*a* and 59*b* of the primary coil 59 extend close to the bottom 61*a* of the case 61 (see FIG. 4), and are individually connected to the primary coil positive terminal 67 and the primary/secondary coil negative terminal 68, respectively.

The following describes the positional relationship between the engine 32 and the fuel tank 26 when the engine 32 is swung.

Figure 7A:
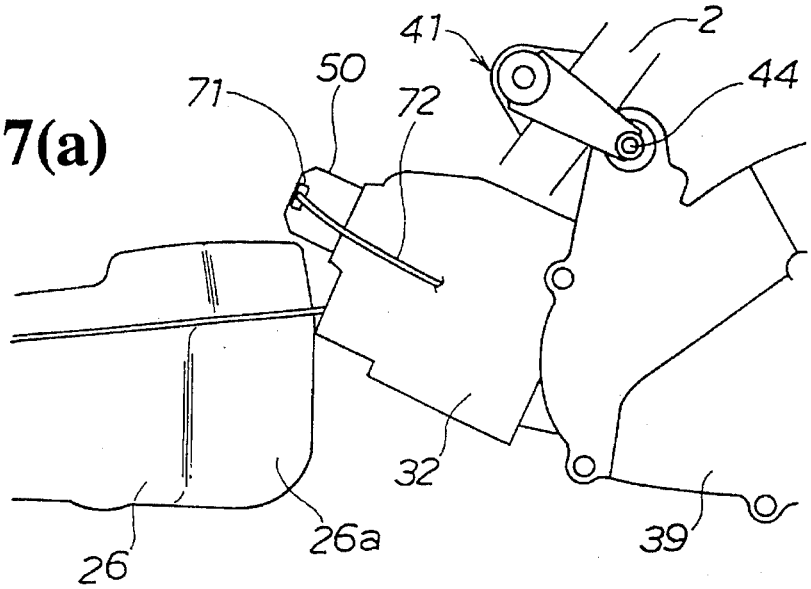
Figure 7B:
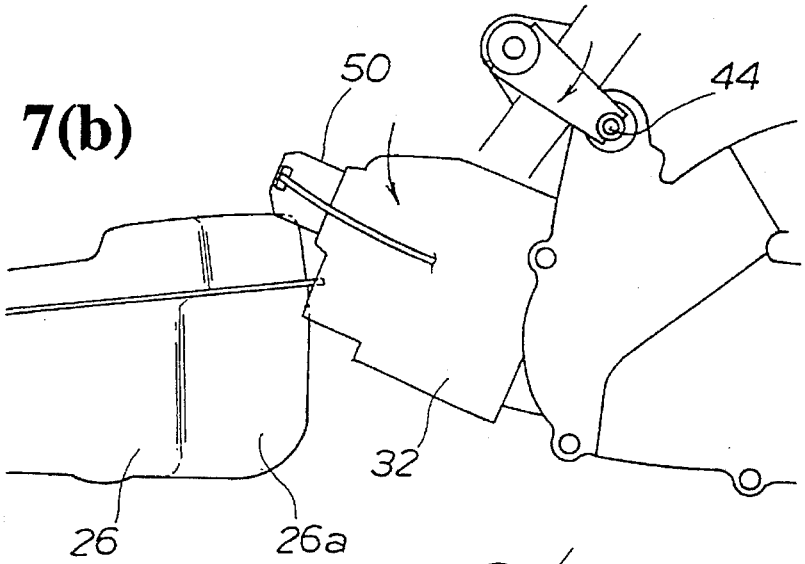
Figure 7C:
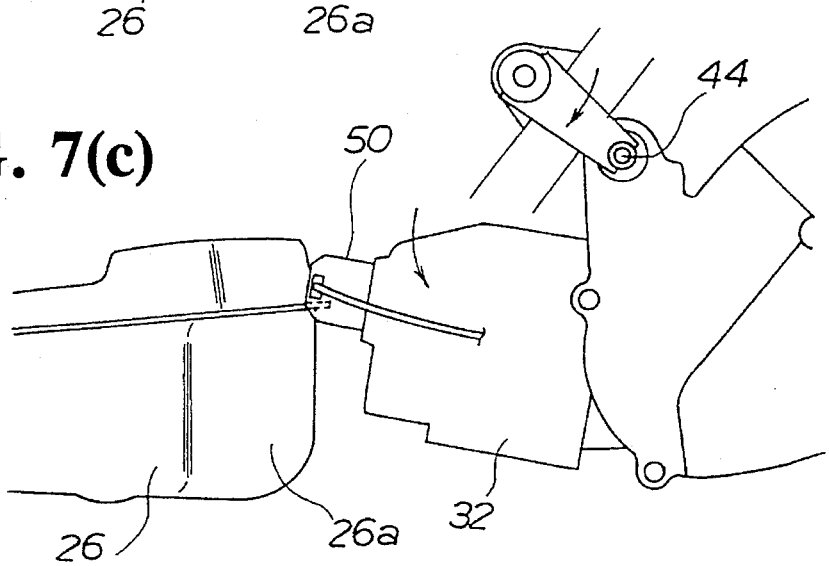

FIGS. 7(*a*), 7(*b*), and 7(*c*) are side views illustrating the swing operation of the engine 32 in relation to the fuel tank 26 according to the present invention.

When the rear cushion 47 (see FIG. 1) is in an intermediate position between its most expanded position and its most contracted position, the pivot 44 of the link mechanism 41 has a relatively high position and the ignition coil device 50 is positioned above the upper end of the rear end surface 26*a* of the fuel tank 26 as shown in FIG. 7(*a*).

When the rear cushion 47 is in the most expanded position, the pivot 44 has a position lower than that shown in FIG. 7(*a*), and the ignition coil device 50 is positioned in the vicinity of the upper end of the rear end surface 26*a* of the fuel tank 26 as shown in FIG. 7(*b*), because the engine 32 is swung counterclockwise as viewed in FIG. 7(*b*).

When the rear cushion 47 is in the most contracted position, the pivot 44 is positioned lower than that shown in FIG. 7(*a*), and the ignition coil device 50 is positioned slightly lower than the position shown in FIG. 7(*b*) in the vicinity of the upper portion of the rear end surface 26*a* of the fuel tank 26 as shown in FIG. 7(*c*), because the engine 32 is further swung counterclockwise.

In this manner, the spark plug 35 (see FIG. 4) and the ignition coil device 50 are mounted on the engine 32 and are capable of swinging through the link mechanism 41 with respect to the body frame 2. Accordingly, the range of swinging of the spark plug 35 and the ignition coil device 50 can be made narrow. As a result, the fuel tank 26 can be located close to the engine 32, thereby allowing effective use of space.

The operation of the ignition coil device 50 will now be described with reference to FIG. 5.

When a low voltage is applied from the CDI unit 69 through the primary coil positive terminal 67, the primary coil 59 and the primary/secondary coil negative terminal 68, a high-voltage current is generated in the secondary coil 56 which flows through the cap member 52 and the spark plug 35 to ground. The generated spark from the spark plug 35 ignites fuel in the engine 32 (see FIG. 4).

The present invention has the following effects.

The ignition coil device employs primary coil ends that extend close to the bottom of the case and which are individually connected to terminals extending substantially perpendicular to the longitudinal axis of the spark plug. With this arrangement, the coil ends and the external wiring are not passed through a sealing member of the ignition coil, thereby improving the sealability of the ignition coil. Further, because the coil ends and the external wiring do not interfere with or rub against the sealing member, they are prevented from being worn by rubbing against sealing member due to vibrations, thereby improving the durability of the external wiring.

Further, as the coil ends of the primary coil extend close to the bottom of the case, the primary coil can be securely wound to the end of windings (i.e., an end position of the primary coil windings can be made specific).

In addition, because the coil ends of the primary coil are individually connected to terminals extending substantially perpendicular to the longitudinal axis of the spark plug, the space around the bottom of the case can be effectively used.

Further according to the invention, the spark plug is mounted on the engine and the engine is swingably mounted through the link mechanism to the body frame. With this arrangement, the swing range of the spark plug can be made narrow. Accordingly, the swing range of the ignition coil device can also be made narrow. As a result, the space around the ignition coil device can be effectively used.

Further, as the terminals are disconnectably connected through the coupler to the external wiring, a wiring operation can be easily carried out. Accordingly, the ignition coil device can be easily applied to an engine with a different length of external wiring.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ignition coil device comprising:

a plug cap engaging a spark plug;

a secondary coil coaxially surrounding said plug cap;

a core mounted between said plug cap and said secondary coil, said core having a tubular shape and being integrally mounted on said plug cap;

a secondary coil bobbin coaxially surrounding and separate from said plug cap, said secondary coil being wound on said secondary coil bobbin;

a primary coil coaxially surrounding said secondary coil;

a cylindrical case surrounding said plug cap, said core, said secondary coil bobbin, said secondary coil and said primary coil;

a sealing member sealing an opening of said cylindrical case, primary coil ends of said primary coil extending to a side of said cylindrical case opposite the spark plug; and terminals extending substantially perpendicular to a longitudinal axis of the spark plug, said primary coil ends being individually connected to said terminals.

2. The ignition coil device according to claim 1, wherein the spark plug is mounted on an engine of a vehicle, the engine being swingably mounted to a frame of the vehicle by a link mechanism.

3. An ignition coil unit connector comprising:

a plug cap engaging a spark plug;

a secondary coil coaxially surrounding said plug cap and having secondary coil ends electrically coupled to the spark plug;

a core mounted between said plug cap and said secondary coil, said core having a tubular shape and being integrally mounted on said plug cap;

a secondary coil bobbin coaxially surrounding and separate from said plug cap, said secondary coil being wound on said secondary coil bobbin;

a primary coil coaxially surrounding said secondary coil and having primary coil ends coupled to an external wire;

a substantially cylindrical case surrounding said plug cap, said core, said secondary coil, and said primary coil;

a coupler socket radially disposed within said substantially cylindrical case; and a coupler connecting the external wire to said coupler socket.

4. The ignition coil unit connector of claim 3, wherein said coupler comprises a flexible boot establishing a seal between said coupler and said coupler socket when said coupler and said coupler socket are engaged.

5. The ignition coil unit connector of claim 3, further comprising a flexible sealing member establishing a seal between said substantially cylindrical case and an engine cover surrounding an engine.

6. The ignition coil unit connector of claim 5, wherein the engine is pivotally connected to a vehicle frame.

7. The ignition coil unit connector of claim 5, wherein the ignition coil supplies high voltage to a spark plug which is a vehicle spark plug.

8. The ignition coil unit connector of claim 7, wherein the vehicle is a motorcycle.

9. An ignition coil device comprising:

a plug cap for mounting adjacent to a spark plug;

a secondary coil coaxially surrounding said plug cap;

a core mounted between said plug cap and said secondary core, said core having a tubular shape and being integrally mounted on said plug cap;

a secondary coil bobbin coaxially surrounding and separate from said plug cap, said secondary coil being wound on said secondary coil bobbin;

a primary coil coaxially surrounding said secondary coil;

a housing surrounding said plug cap, said core, said secondary coil bobbin, said secondary coil and said primary coil;

a sealing member sealing an opening of said housing, primary coil ends of said primary coil extending to a side of said housing opposite the spark plug; and terminals extending substantially perpendicular to a longitudinal axis of the spark plug, said primary coil ends being individually connected to said terminals.

10. The ignition coil device according to claim 9, wherein the spark plug is mounted on an engine of a vehicle, the engine being swingably mounted to a frame of the vehicle by a link mechanism.

11. An ignition coil unit connector comprising:

a plug cap engaging a spark plug;

a secondary coil coaxially surrounding said plug cap and having secondary coil ends electrically coupled to the spark plug;

a core mounted between said plug cap and said secondary coil, said core having a tubular shape and being integrally mounted on said plug cap;

a secondary coil bobbin coaxially surrounding and separate from said plug cap, said secondary coil being wound on said secondary coil bobbin;

a primary coil coaxially surrounding said secondary coil and having primary coil ends coupled to an external wire;

a housing surrounding said plug cap, said core, said secondary coil and said primary coil;

a coupler socket radially disposed within said housing; and a coupler connecting the external wire to said coupler socket.

12. The ignition coil unit connector of claim 11, wherein said coupler comprises a flexible boot establishing a seal between said coupler and said coupler socket when said coupler and said coupler socket are engaged.

13. The ignition coil unit connector of claim 11, further comprising a flexible sealing member establishing a seal between said housing and an engine cover surrounding an engine.

14. The ignition coil unit connector of claim 13, wherein the engine is pivotally connected to a vehicle frame.

15. The ignition coil unit connector of claim 13, wherein the ignition coil supplies high voltage to a spark plug which is a vehicle spark plug.

16. The ignition coil unit connector of claim 15, wherein the vehicle is a motorcycle.

* * * * *